US012245644B2

(12) United States Patent
Mayes

(10) Patent No.: US 12,245,644 B2
(45) Date of Patent: Mar. 11, 2025

(54) SUPPORT GARMENTS

(71) Applicant: Tamika Mayes, Detroit, MI (US)

(72) Inventor: Tamika Mayes, Detroit, MI (US)

( * ) Notice: Subject to any disclaimer, the term of this patent is extended or adjusted under 35 U.S.C. 154(b) by 87 days.

(21) Appl. No.: 17/732,210

(22) Filed: Apr. 28, 2022

(65) Prior Publication Data

US 2023/0346050 A1 Nov. 2, 2023

(51) Int. Cl.
*A41C 3/00* (2006.01)

(52) U.S. Cl.
CPC ..... *A41C 3/0064* (2013.01)

(58) Field of Classification Search
None
See application file for complete search history.

(56) References Cited

U.S. PATENT DOCUMENTS 5,087,499 A * 2/1992 Sullivan ..... A41D 31/24 424/447
5,690,537 A * 11/1997 Kalmus ..... A41C 3/10 450/55
5,820,444 A * 10/1998 McGaughey ..... A41C 3/0064 450/70
5,867,827 A * 2/1999 Wilkinson ..... A63B 21/4007 2/69
5,913,408 A * 6/1999 Shanahan ..... A41D 27/10 2/69
6,209,136 B1 * 4/2001 Ophardt ..... A41D 25/06 2/144
6,814,647 B1 * 11/2004 Huang ..... A41C 3/14 450/39
7,117,539 B1 * 10/2006 Baacke ..... A41D 1/04 2/102

(Continued)

FOREIGN PATENT DOCUMENTS

WO 2014049786 A1 4/2014
WO 2015013806 A1 2/2015

OTHER PUBLICATIONS

Cooper, Patrick. "The Only Way to Wear a Suit-Step 3." The Tailor Company. Sep. 10, 2019. https://www.thetailorcompany.com/blog/suitarmholes#:~:text=Slip%20on%20your%20jacket., forget%20to%20move%20your%20arm. (Year: 2019).*

(Continued)

*Primary Examiner* — Grace Huang
(74) *Attorney, Agent, or Firm* — Fitch, Even, Tabin & Flannery, LLP

(57) ABSTRACT

A seamless support garment. The garment has arm openings about 50 to 100 percent greater than a diameter of a user's arms; a neck opening about 2 to 4 times greater than a diameter of an average user's neck; a portion of the arm openings and neck opening opposite each other form integral shoulder straps; a band configured to fit at an under bust of the user defining a torso opening; two cup regions positioned above the band to receive the user's breasts, two cup regions positioned above the band to receive the user's breasts, the cup regions being 100-200 percent thicker at a portion of the cup configured for placement of the user's nipple and tapering to a garment body thickness as the taper extends away from the nipple portion; wherein, the support garment is configured from a material having between 50-200 percent elasticity.

10 Claims, 16 Drawing Sheets

(56) References Cited

U.S. PATENT DOCUMENTS 7,179,150 B2 * 2/2007 Luk ..... A41C 3/122 450/39
7,549,281 B2 * 6/2009 Kuwano ..... D01F 2/06 57/244
7,604,526 B2 * 10/2009 Liu ..... A41C 3/122 450/39
7,611,999 B2 * 11/2009 McMurray ..... D04B 1/126 66/196
7,882,569 B2 * 2/2011 Liu ..... A41C 3/126 2/243.1
8,167,924 B2 * 5/2012 Rosenbaum ..... A61F 7/00 450/86
8,550,872 B2 * 10/2013 Upton ..... A41C 3/00 450/65
8,562,388 B2 * 10/2013 Izzo ..... A61F 2/52 450/57
8,647,168 B2 * 2/2014 Anvaripour ..... A41C 1/003 450/74
9,210,956 B2 * 12/2015 Bolt ..... A41C 3/005
9,545,124 B1 1/2017 Thompson
9,669,012 B2 * 6/2017 Anderson ..... A61K 9/0024
9,700,081 B2 * 7/2017 Tempesta ..... A41C 3/0035
10,004,279 B2 * 6/2018 Carlton ..... A41D 31/185
10,080,391 B2 * 9/2018 Rundle ..... A41D 3/08
10,212,977 B2 * 2/2019 Eyal ..... A41C 3/0028
10,568,364 B2 * 2/2020 Villarreal ..... A41B 13/06
10,568,365 B2 * 2/2020 Hirakubo ..... A41F 15/002
10,640,896 B2 * 5/2020 Barnes ..... D04B 1/18
11,142,854 B2 * 10/2021 Lucas Gaus ..... D04B 1/108
11,284,648 B2 * 3/2022 Carlino ..... A41C 3/0057
11,406,141 B2 * 8/2022 Lucas Gaus ..... A41C 3/144
11,684,092 B2 * 6/2023 Roddis ..... A41C 3/0014 2/243.1
11,692,304 B2 * 7/2023 Farmer ..... B32B 3/266 450/39
11,839,242 B2 * 12/2023 Almog ..... A41D 27/26
2003/0026914 A1 * 2/2003 Green ..... D06M 16/00 427/407.1
2006/0154566 A1 * 7/2006 Nunez ..... A41C 3/0064 450/37
2006/0264137 A1 * 11/2006 Ishihara ..... D04B 1/14 442/317
2008/0153388 A1 * 6/2008 Liu ..... A41C 3/00 450/39
2010/0035514 A1 * 2/2010 Wong ..... A41C 3/10 450/55
2010/0166832 A1 * 7/2010 Ingle ..... D06M 23/16 2/400
2010/0180358 A1 * 7/2010 Drummond ..... A41D 7/00 2/244
2010/0184355 A1 * 7/2010 Kennedy ..... A41C 1/06 66/171
2013/0232661 A1 * 9/2013 Huntley ..... A41D 1/215 2/104
2014/0007316 A1 * 1/2014 Tommarello ..... A41D 13/1209 2/114
2015/0289571 A1 10/2015 Yamamoto et al.
2016/0324872 A1 * 11/2016 Bruce ..... A61L 15/44
2018/0014579 A1 1/2018 Gumlaw
2018/0132540 A1 * 5/2018 Su ..... A41C 3/0014
2018/0271176 A1 * 9/2018 Harrell ..... B32B 7/12
2021/0093024 A1 * 4/2021 Christensen ..... A41D 13/1218
2021/0137206 A1 * 5/2021 Reguillon ..... A43B 1/04
2022/0030960 A1 * 2/2022 Almog ..... D04B 1/243
2022/0295910 A1 * 9/2022 Mardesic ..... A41D 1/22
2023/0210195 A1 * 7/2023 Smyczek ..... A41C 3/0057 450/1

OTHER PUBLICATIONS

"Maximum Strength 1% Hydrocortisone Itch Relief Cooling Gel: Cortizone-10®." Cortizone, www.cortizone10.com/en-us/products/gels-and-ointments/cooling-anti-itch-gel. Accessed Nov. 7, 2023. (Year: 2023).*

Holzmann, Margaret. "Neck Size and Design for Garments." How to Size and Shape a Neck for a Garment, The Knitwit, Feb. 14, 2020, www.theknitwit.org/blog/2020/2/5/how-to-size-and-shape-necklines#:~:text=Head%20circumference%20for%20a%20Woman , 14.5%E2%80%9D%20for%20a%20Man's%20garment. (Year: 2020).*

"Block." Merriam-Webster. https://www.merriam-webster.com/dictionary/block#dictionary-entry-2. Accessed Nov. 7, 2023. (Year: 2023).*

* cited by examiner

SUPPORT GARMENTS

FIELD

Presented herein are support garments and more particularly support garments configured for a person undergoing breast treatments.

BACKGROUND

Unless otherwise indicated herein, the materials described in this section are not prior art to the claims and are not admitted as being prior art by inclusion in this section.

Treatment of breast cancer is typically surgical excision, chemotherapy or radiation therapy of a cancerous mass; use of anti-cancer agents and anti-estrogens; and the like and combinations thereof. There are two types of surgery: breast-conserving surgery that removes only the mass, and mastectomy surgery that removes the breast partially or completely.

Breast cancer treatments often have deleterious effects on the body. Often, patients or survivors will endure skin peeling, discomfort, and swelling around and within the breast tissue. Patients may have radiation "burns" beneath or around the breast and within the axilla. Also, they may have soreness, irritation, peeling, and burning of the nipple and areola. Finally, patients may have lasting heaviness and soreness of the breast from acute and chronic swelling, which may last from 6 weeks to 5 years after treatment.

A breast support garment (e.g., support garment, bra or brassiere) is generally an undergarment worn on the chest, is mainly used to not only support the breast, but also to shape the bust and prevent its shape from collapsing. A wide variety of such support garments are known with various colors, designs and materials have been commercialized.

In the art of breast support garments for breast cancer patients, restoring the bulge of the bust is one of the major objectives using materials such as silicone, urethane, cloth, cotton, beads, red beans, etc., and even pockets to insert and insert pads. Breast support garments for breast cancer patients have also attempted designs to increase comfort, ease of use, and function to a person who is battling cancer. However, in general, the available garments have not kept pace with advancements in breast cancer treatment technologies and practices. Due to advances in surgery and radiation, treatment techniques and early detection, more and more women are being treated with lumpectomy and radiation therapy instead of a mastectomy. Radiation therapy still typically causes significant irritation of the skin in the treated area. The skin may feel raw, blistered, tender, and sensitive to touch, rubbing, movement, or stretching. Attempts have been made in the art to address these issues. In one attempt, the support garment is shaped for displacing an unaffected breast of a patient out of a radiotherapy treatment field (See generally, WO2015013806A1 to RAFFIS). In another attempt, a post-surgery support garment includes apertures appropriately sited to accommodate tubes from treatment devices (See, U.S. Pat. No. 9,545,124B1 to THOMPSON). In another attempt, an attachment component configured to removably couple an insert to the inner layer of a support garment is provided (See generally, US20180014579A1 to GUMLAW).

Despite these advances in the art, support garments are not known to focus on the needs of early-stage breast cancer patients (or non-surgery treatment regiments). That is, many focus on prosthetics, cancer treatment tubes, nursing, etc. Further, many such support garments in the art have not evolved to meet new construction and manufacturing technologies. Sports bras do not provide a useful solution as their design focuses on hold or compression of muscles. Similarly, leisure bras that focus on softness, leave many other requirements unsatisfied for a support garment of this type.

There is thus a desire and a need in the art for improved support garment configurations and particularly a need in the art for improved support garment configurations for persons undergoing surgical breast cancer treatment, particularly radiation therapy, or pre- or post-surgery recovery.

SUMMARY

Accordingly, to advance at least the aforementioned deficiencies in the art, described herein are support garments and more particularly breast support garments that provide comfort, functional support, and therapeutic effect. In addition, the present garments are designed to be attractive and vogue, with positive affirmation. The present garment configurations are produced sustainably with methods and materials to minimize cost and adverse effects to the wearer and on the environment, while evolving to incorporate advancements in fiber, yarn and fabric performance. These include seamless knitting technologies and minimizing cut and sew methods. The present support garments may be particularly advantageous for persons undergoing pre-or-post cancer therapy, or other treatments or procedures involving the breast.

According to one approach, a seamless support garment configured for use by a person, for example, pre or post breast cancer therapy is provided. The garment may have first and second arm openings configured to be about 50 to 100 percent greater than a diameter of an average user's arms; a neck opening configured to be about 2 to 4 times greater than a diameter of an average user's neck; a portion of the arm openings and neck opening opposite each other form integral shoulder straps; a band configured to fit at an under bust of the user defining a torso opening; two cup regions positioned above the band to receive the user's breasts, two cup regions positioned above the band to receive the user's breasts, the cup regions being 100-200 percent thicker at a portion of the cup configured for placement of the user's nipple and tapering to a garment body thickness as the taper extends away from the nipple portion; wherein, the support garment is configured from a material having between 50-200 percent elasticity.

According to one approach, the garment may further comprise a front closure positioned between the cups of the garments selected from the group consisting of zippers, buttons, hook and loop fasteners, magnets and combinations thereof.

According to one approach, the garment material may be selected from the list consisting of elastic fibers, hypoallergenic yarns, fiber, materials made from acrylic, microfiber, microfiber, linen, hemp, bamboo, flax, neoprene, and combinations thereof.

According to one approach, the garment elasticity may be achieved by elastic fibers comprising elastane or polyether-polyurea copolymer material in the range of 20-100 percent of total composition volume.

According to one approach, the garment may the support garment may be composed of 40-80 percent bamboo viscose.

According to one approach, the support garment neck opening may be configured to extend up to the user's clavicular region.

According to one approach, the support garment may further comprise a second layer composed of silk or satin.

According to one approach, the support garment middle area is configured to separate each breast region by the cups while maintaining direct or close contact with the user. The direct or close contact with the user in the middle area may be achieved by at least one of knitting construction, padding, pleating, ruching and cushions.

According to one approach, the support garment material may be selected from the list consisting of anti-bacterial or antimicrobial materials, polyester, polyester-vinyl composites, vinyl, acrylics, linen, merino wool, hemp, anti-moisture, moisture wicking, breathable fabrics, polyester, polypropylene, merino wool, wool, nylon, micromodal, bamboo, and combinations thereof.

According to one approach, the garment may be impregnated or coated in materials selected for properties selected from the group: cooling, anti-burning, anti-itch, radiation blocking, anti-radio frequency (RF) radiation blocking, electric and magnetic fields (EMFs) blocking, ultraviolet radiation blocking, and combinations thereof.

According to one approach, the support garment material may comprise an EMF blocking and radiation blocking material having 2-15 percent by total composition weight silver fiber and 2-15 percent total composition weight hydrocortisone anti-itch cooling gel coatings.

A method of making a seamless support garment of the present embodiments may include one of the steps of: 3-D printing; sewing; circular knitting; flat knitting and bonding techniques.

According to another approach, a support garment may have first and second arm openings; a neck opening; two cup regions to receive a user's breasts, wherein the garment is impregnated or coated in materials selected for properties selected from the group: cooling, anti-burning and anti-itch, radiation block, anti-radio frequency (RF) radiation blocking, electric and magnetic fields (EMFs) blocking, ultraviolet radiation blocking, and combinations thereof. The garment material may have an EMF blocking and radiation blocking material or similar yarn or composites having 2-15 percent by total composition weight silver fiber and 2-15 percent total composition weight hydrocortisone anti-itch cooling gel coatings.

Other features will become more apparent to persons having ordinary skill in the art to which the processes and methods pertain and from the following description and claims.

BRIEF DESCRIPTION OF THE DRAWINGS

The present embodiments, as well as a non-limiting exemplary mode of use, further objectives and advantages thereof, will best be understood by reference to the following detailed description of an illustrative embodiment when read in conjunction with the accompanying drawings, wherein.

Figure 1:
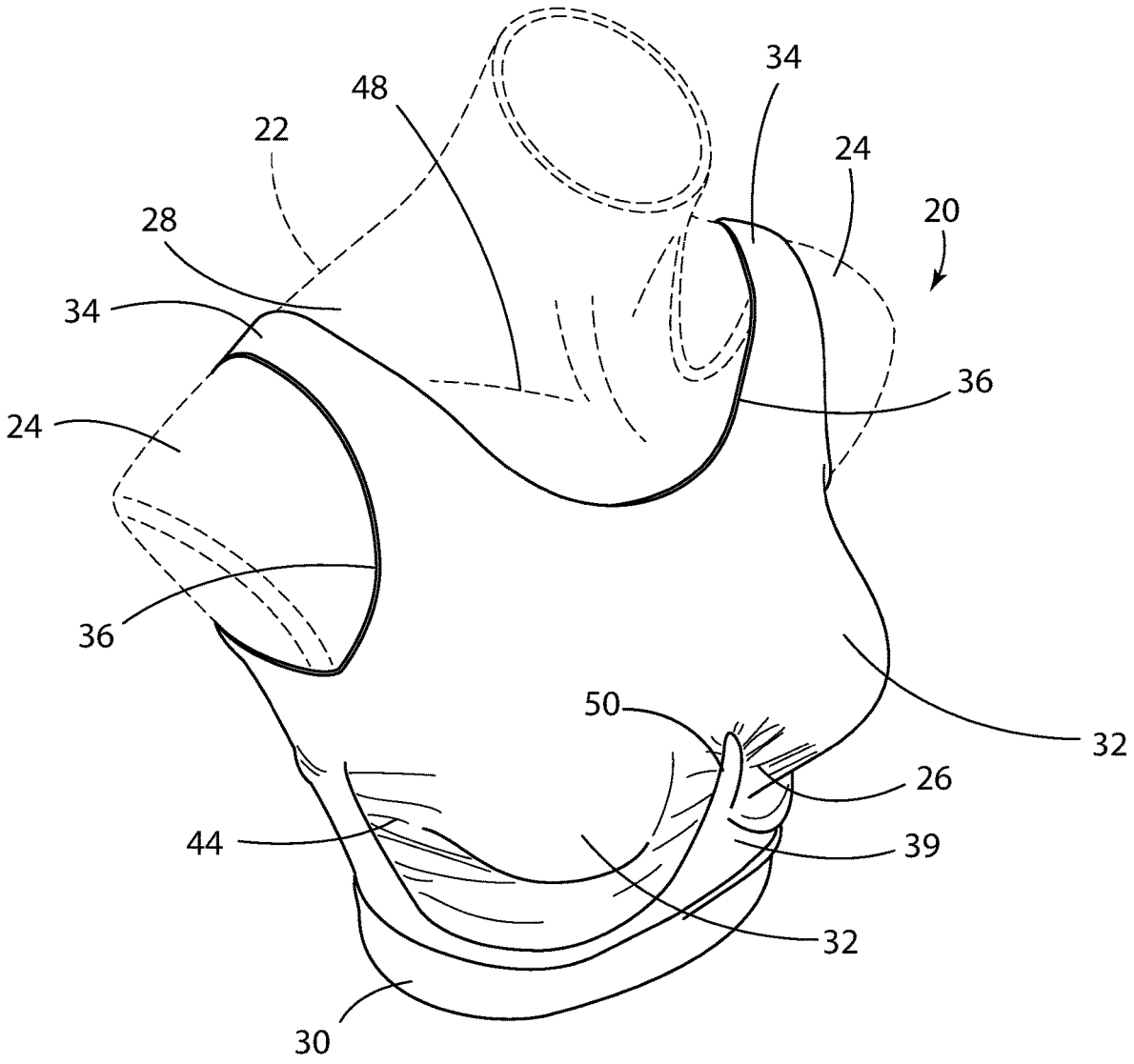
FIG. 1 illustrates a top left perspective view according to one approach of the present support garment embodiments.
Figure 2:
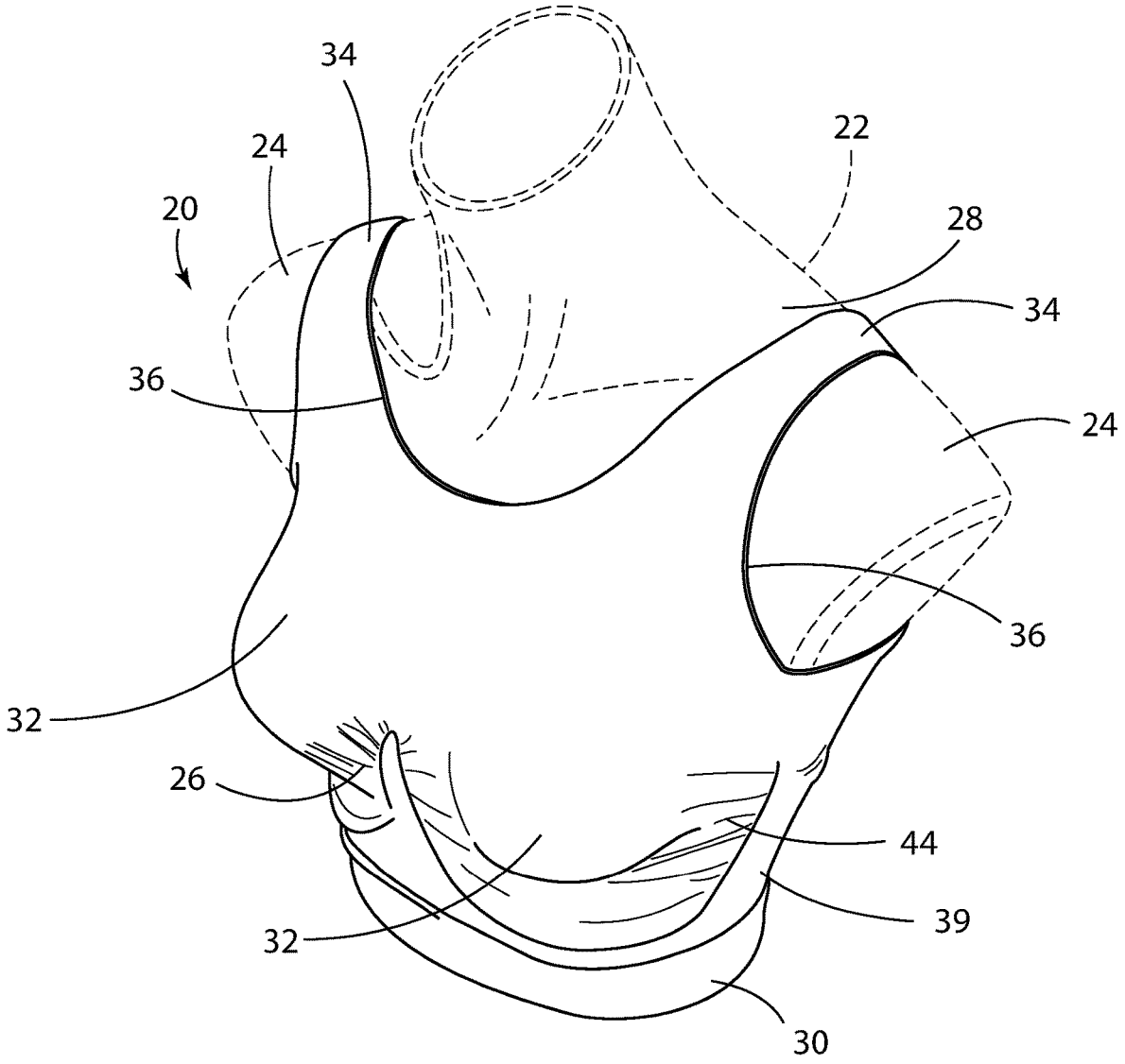
FIG. 2 illustrates a top right perspective view of the support garment of FIG. 1.
Figure 3:
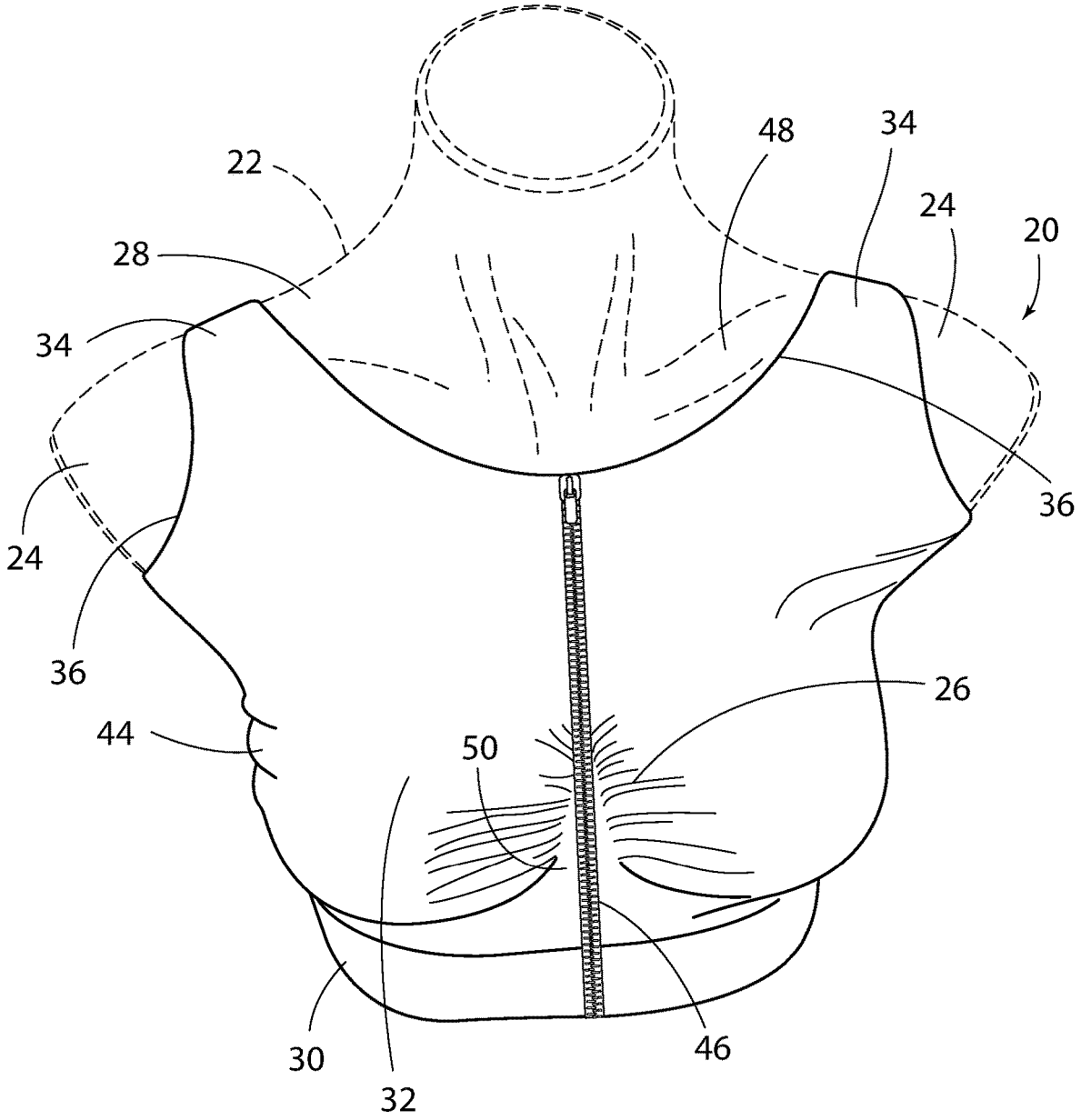
FIG. 3 illustrates a front view of the support garment of FIG. 1 with optional zipper.
Figure 4:
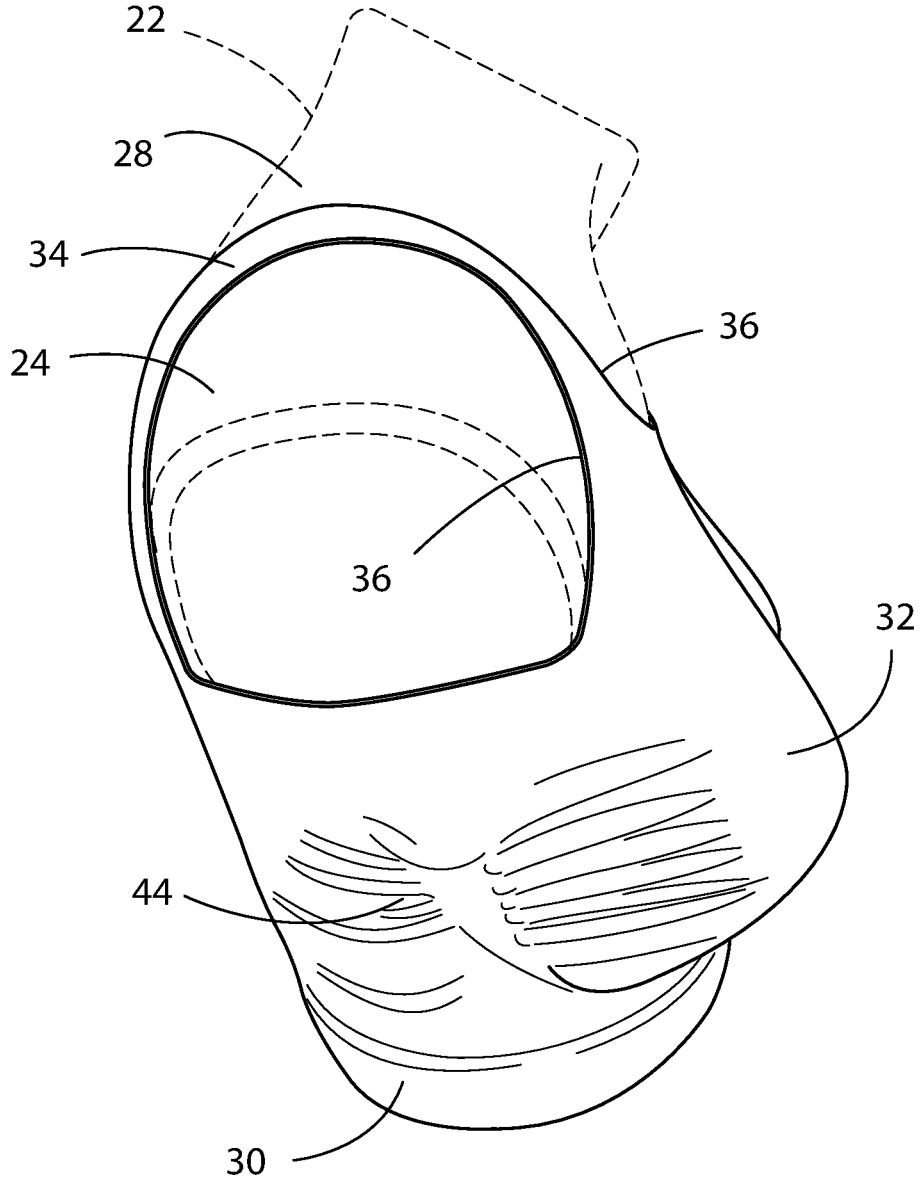
FIG. 4 illustrates a right side elevational view of the support garment of FIG. 1.
Figure 5:
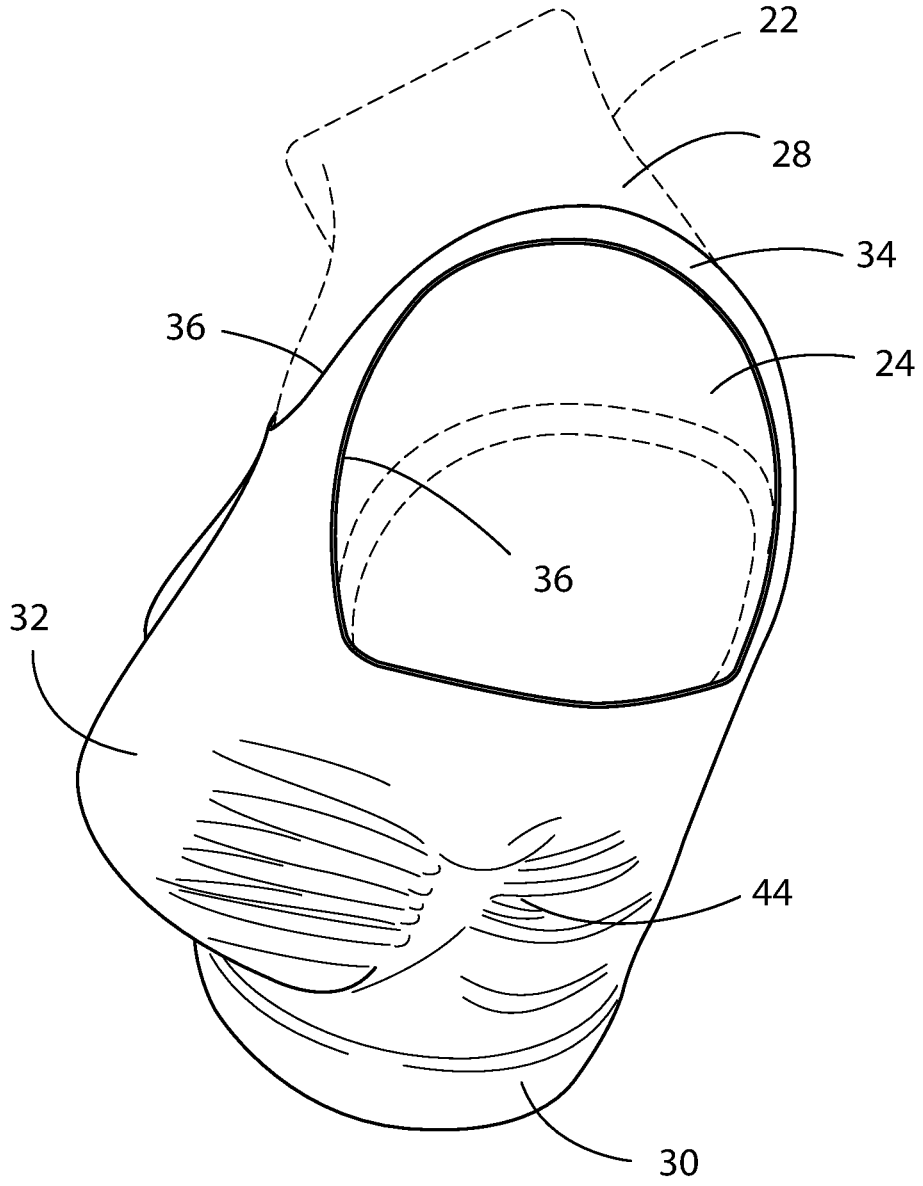
FIG. 5 illustrates left side elevational view of the support garment of FIG. 1.

Corresponding reference characters may indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present embodiments.

While the features described herein may be susceptible to various modifications and alternative forms, specific embodiments thereof are shown by way of example in the drawings and are herein described in detail. It should be understood, however, that the drawings and detailed description thereto are not intended to be limiting to the particular form disclosed, but on the contrary, the intention is to cover all modifications, equivalents and alternatives falling within the spirit and scope of the subject matter as defined by the appended claims.

DETAILED DESCRIPTION

Accordingly, to advance at least the aforementioned deficiencies in the art, described herein are support garments and more particularly breast support garments that provide comfort, functional support, and therapeutic effect. In addition, the present garments are designed to be attractive and vogue, with positive affirmation. The present garment configurations are produced sustainably with methods and materials to minimize cost and adverse effects to the wearer and on the environment, while evolving to incorporate advancements in fiber, yarn and fabric performance. These include seamless knitting technologies and minimizing cut and sew methods. The present garment configurations also may include materials to shield the user from various types of radiation, and provide heeling and comforting materials such as antiseptics, anti-microbials, water wicking, and anti-burn/itch.

Figure 6:
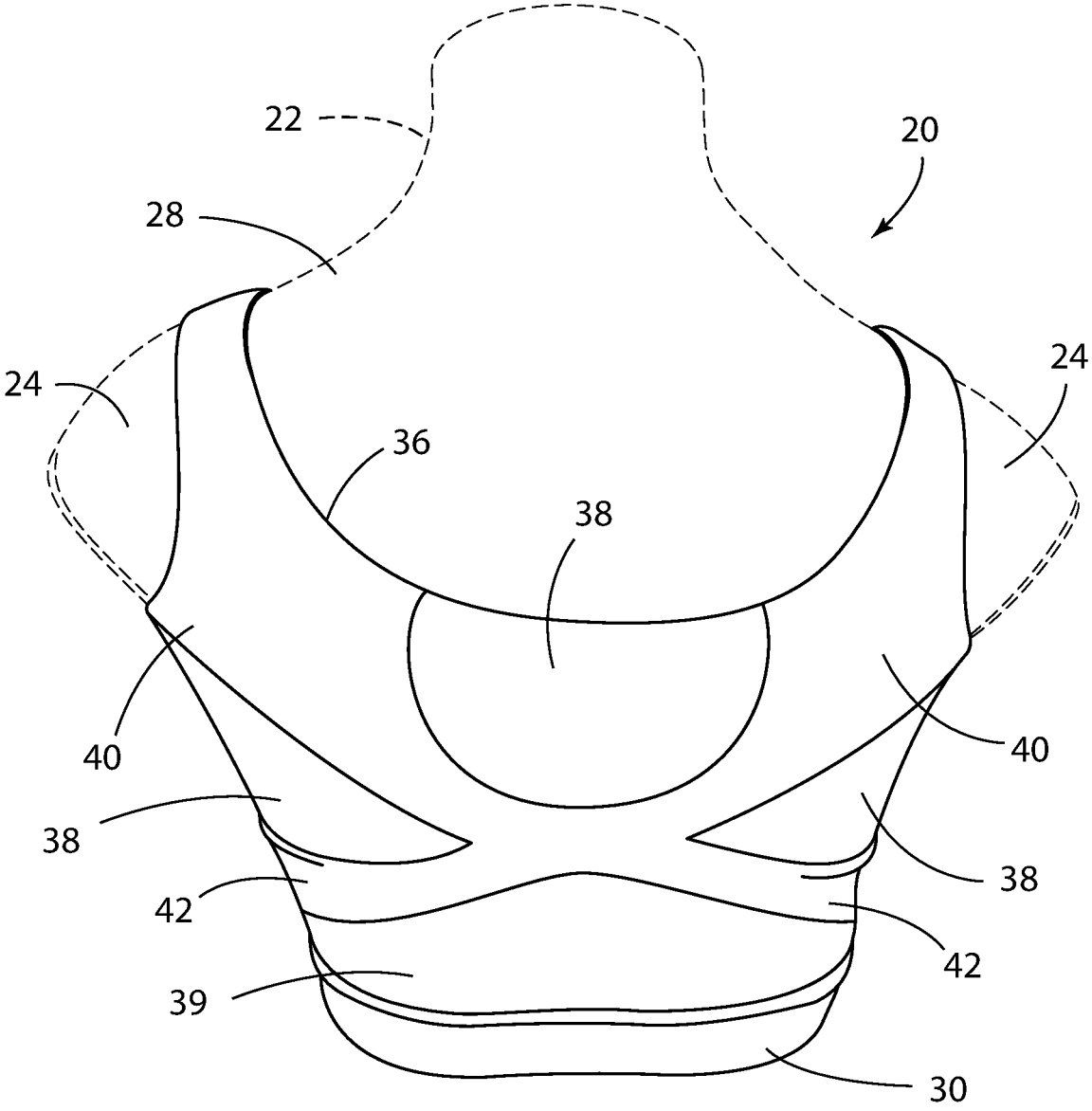
FIG. 6 illustrates a rear view of the support garment of FIG. 1.
Figure 7:
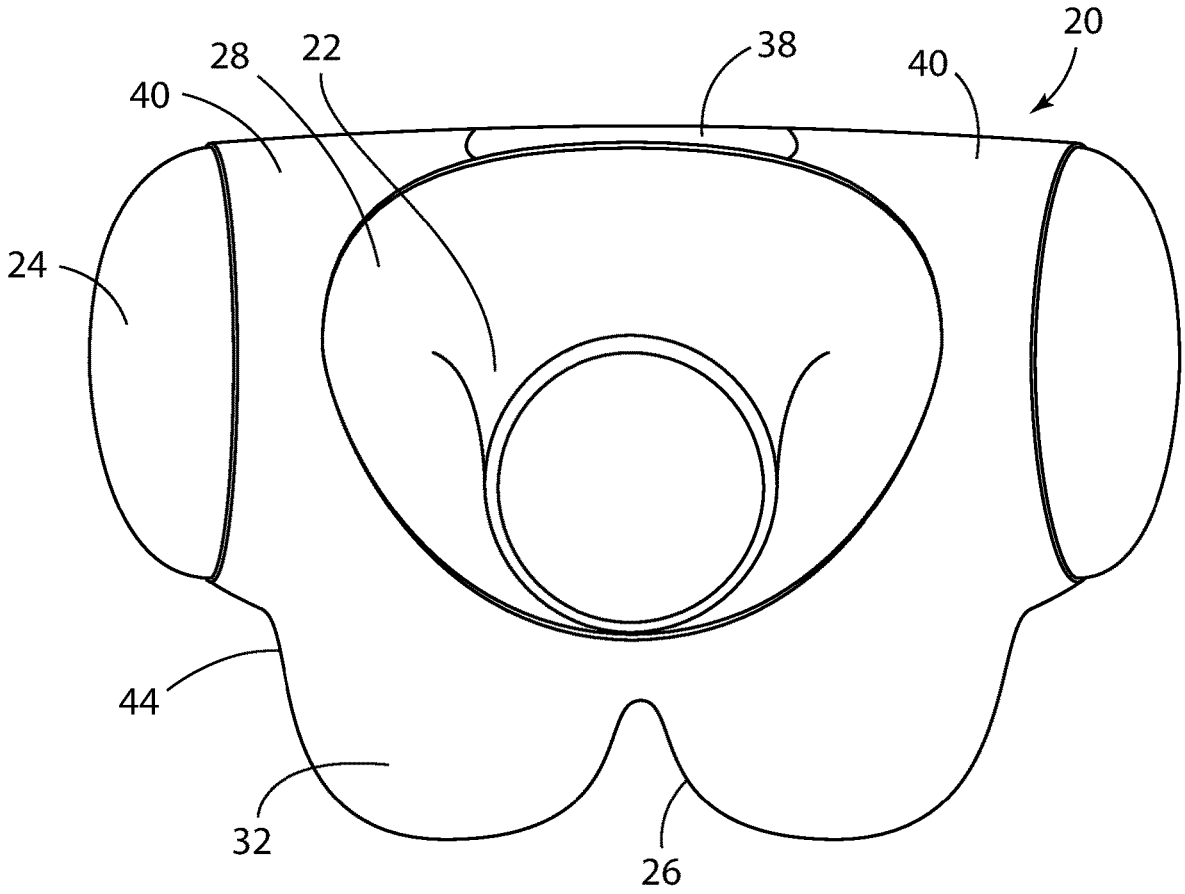
FIG. 7 illustrates a top view of the support garment of FIG. 1.
Figure 8:
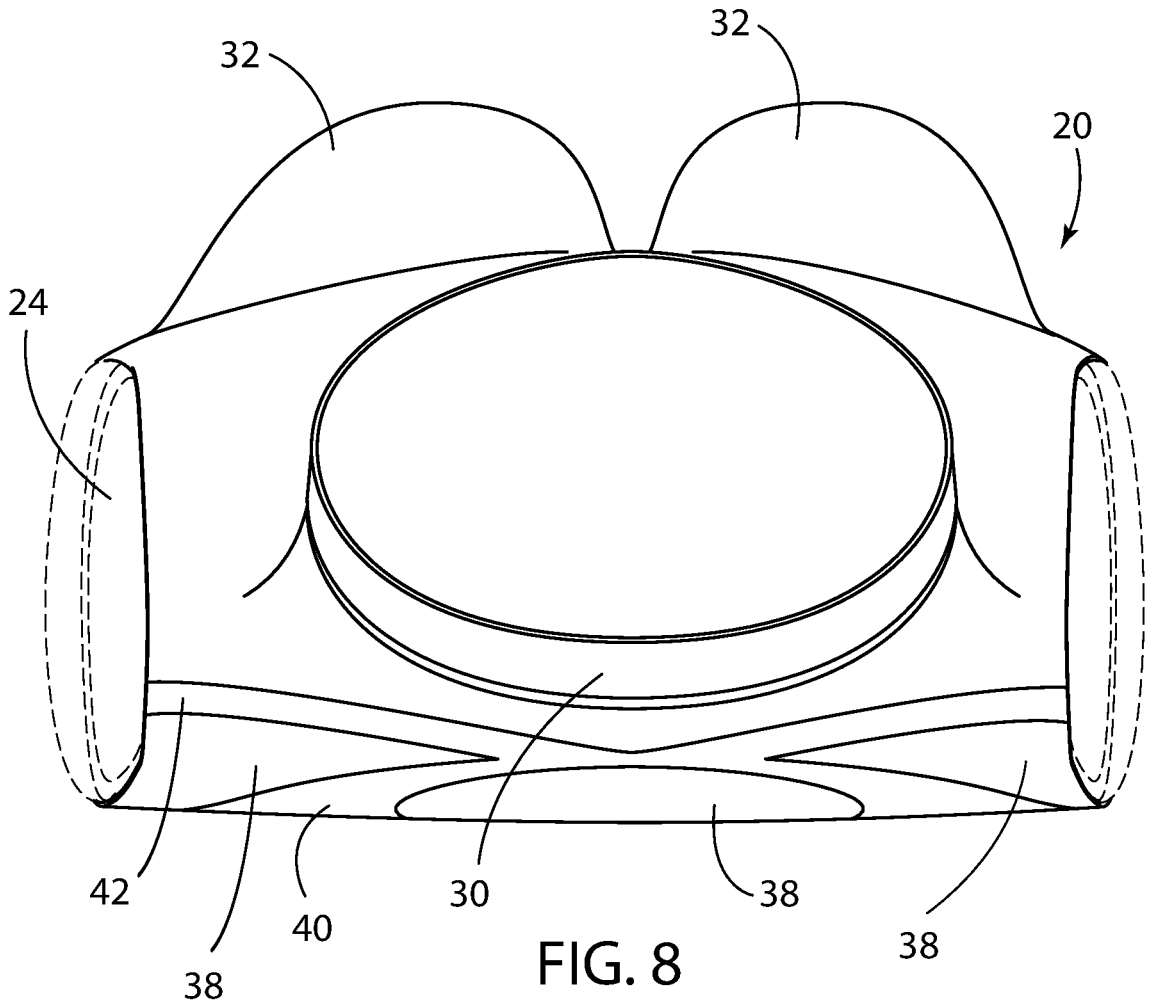
FIG. 8 illustrates a bottom view of the support garment of FIG. 1.
Figure 9:
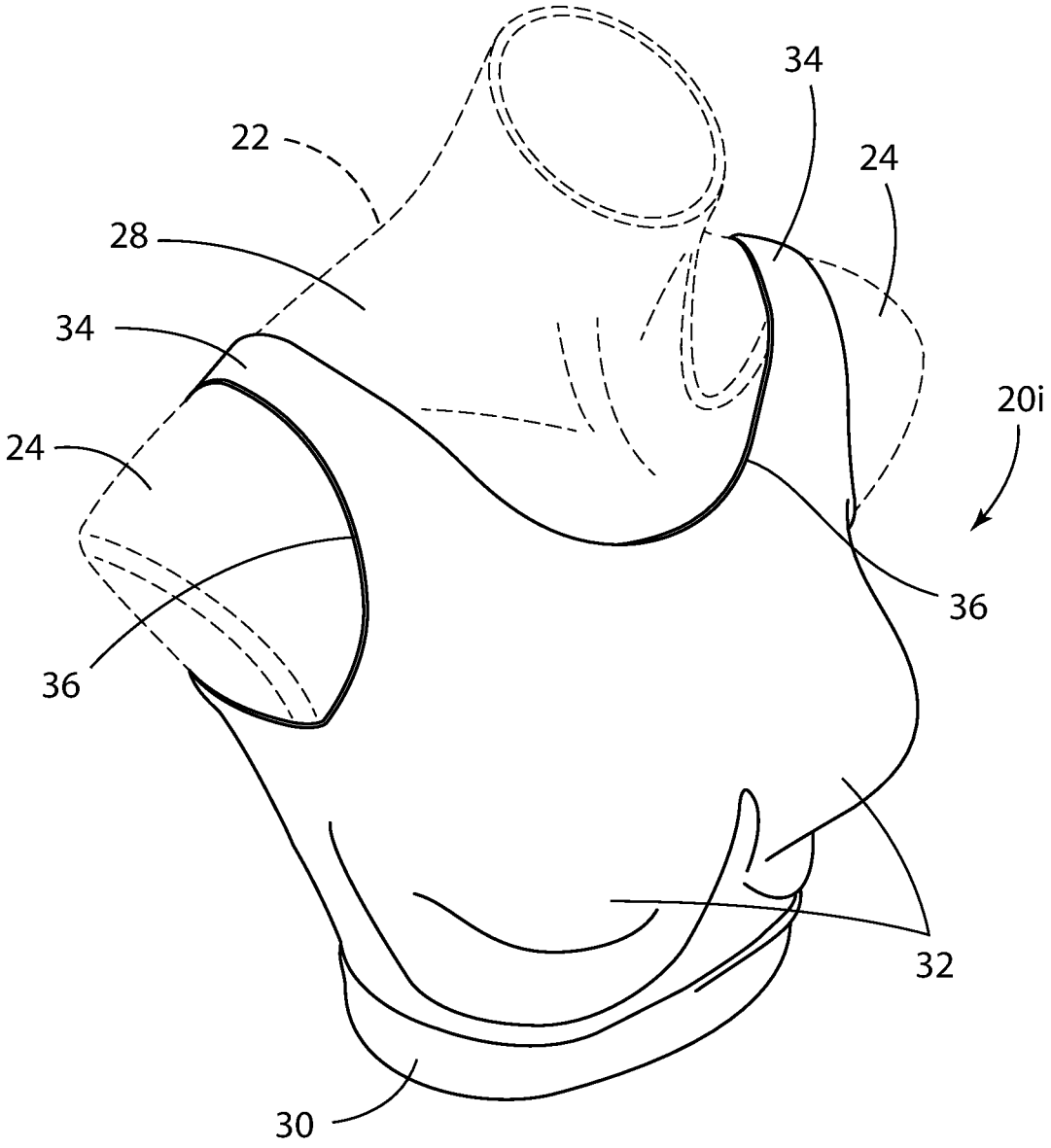
FIG. 9 illustrates a top left perspective view according to another approach of the present support garment embodiments.
Figure 10:
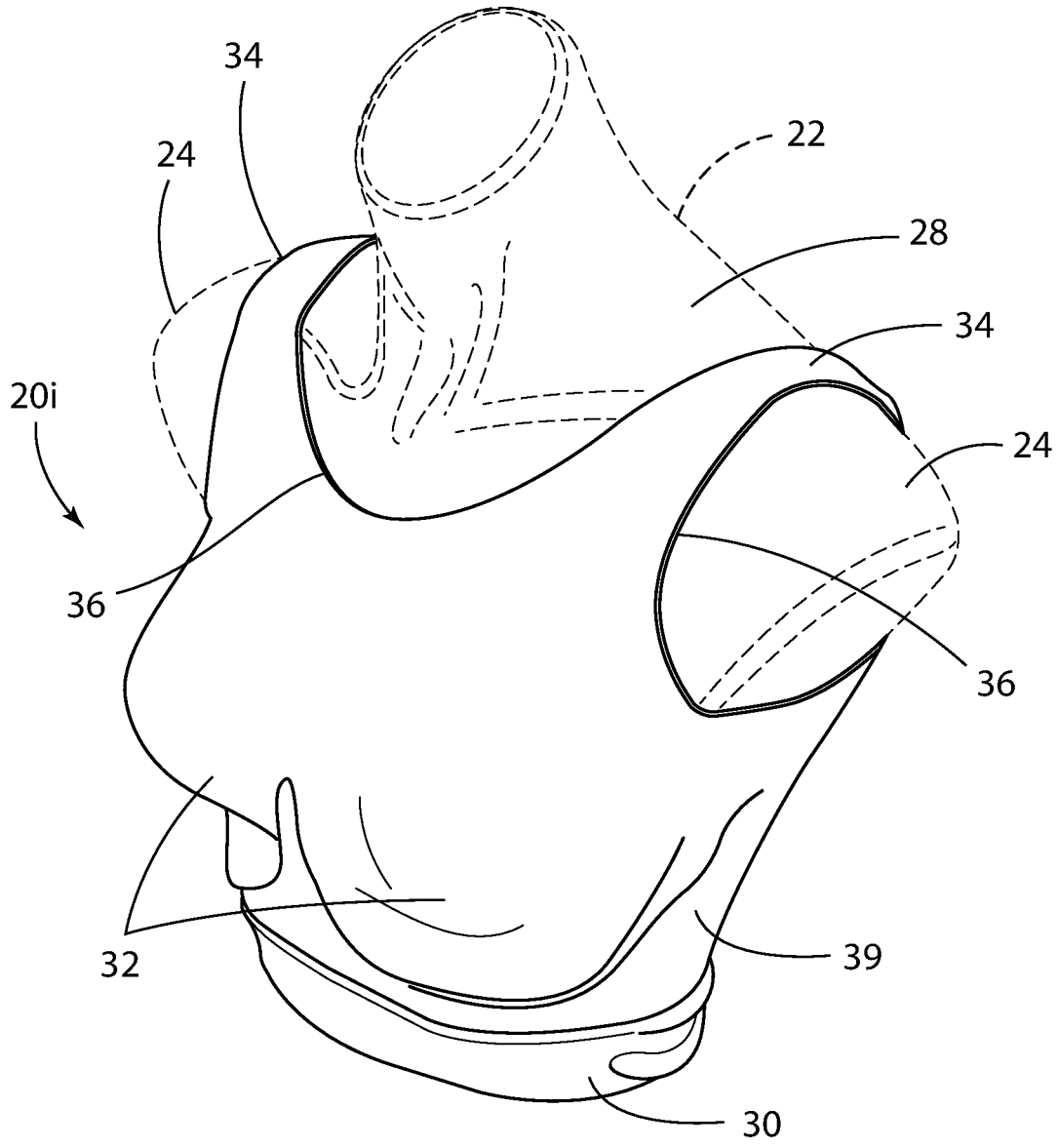
FIG. 10 illustrates a top right perspective view of the support garment of FIG. 9.
Figure 11:
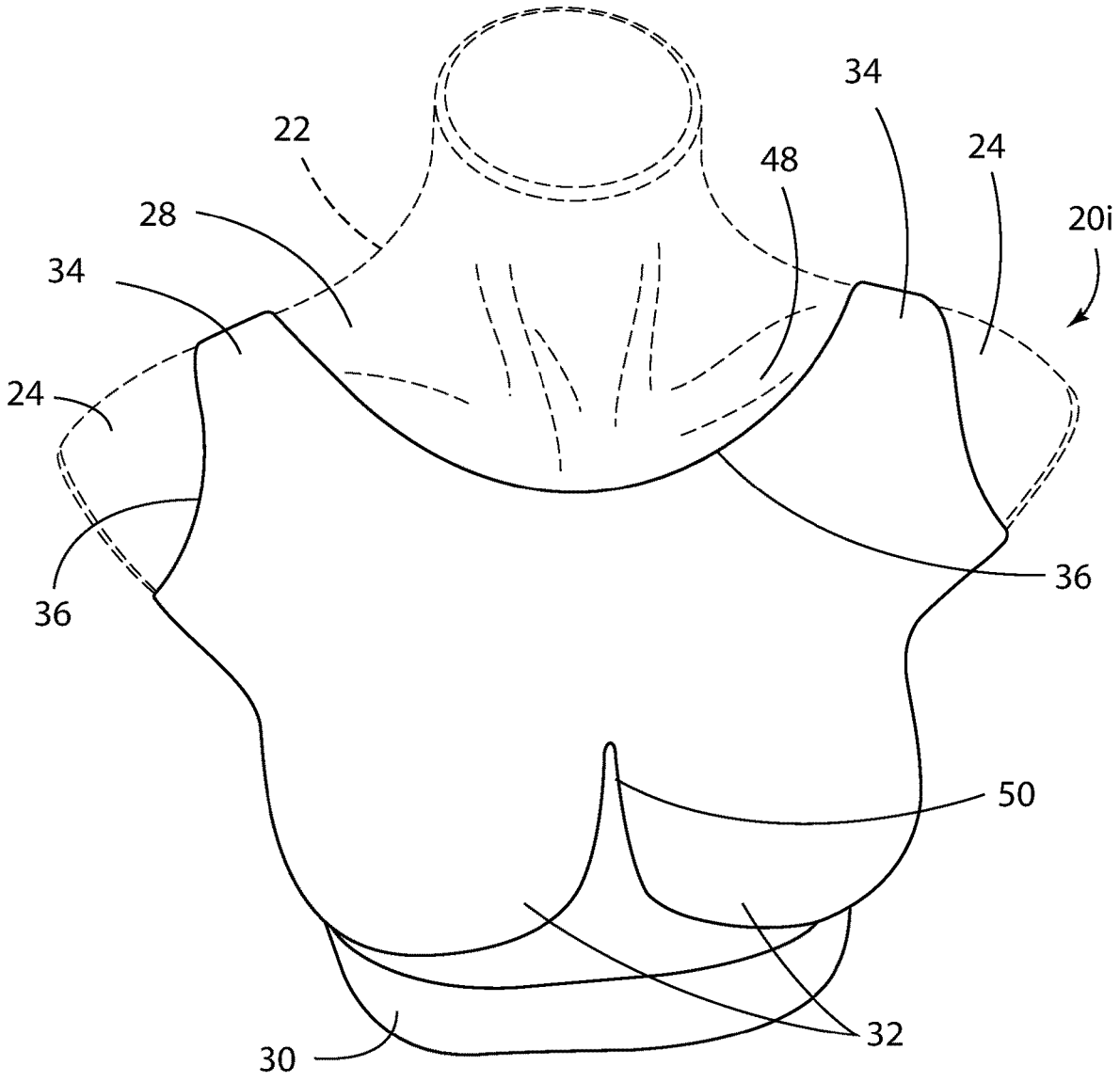
FIG. 11 illustrates a front view of the support garment of FIG. 9.
Figure 12:
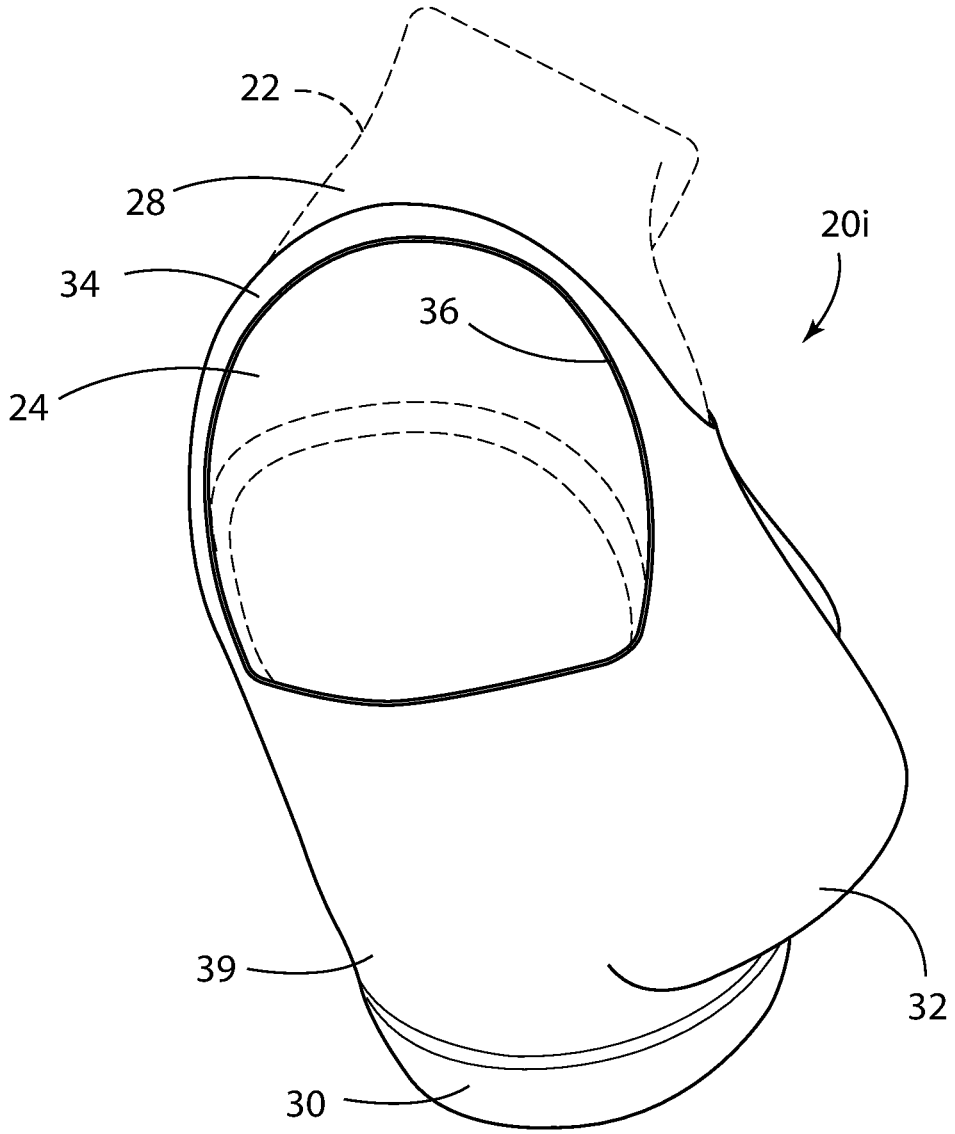
FIG. 12 illustrates a right side elevational view of the support garment of FIG. 9.
Figure 13:
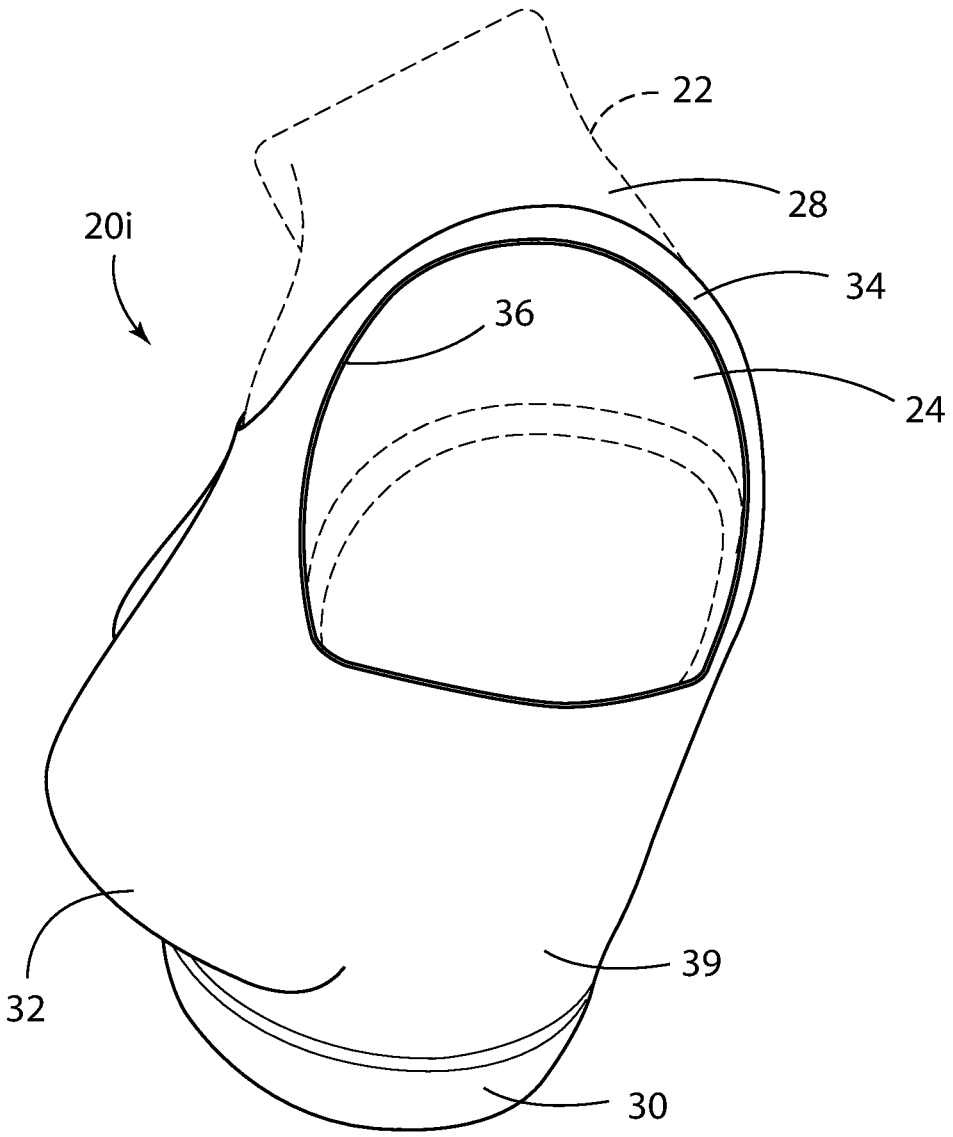
FIG. 13 illustrates left side elevational view of the support garment of FIG. 9.
Figure 14:
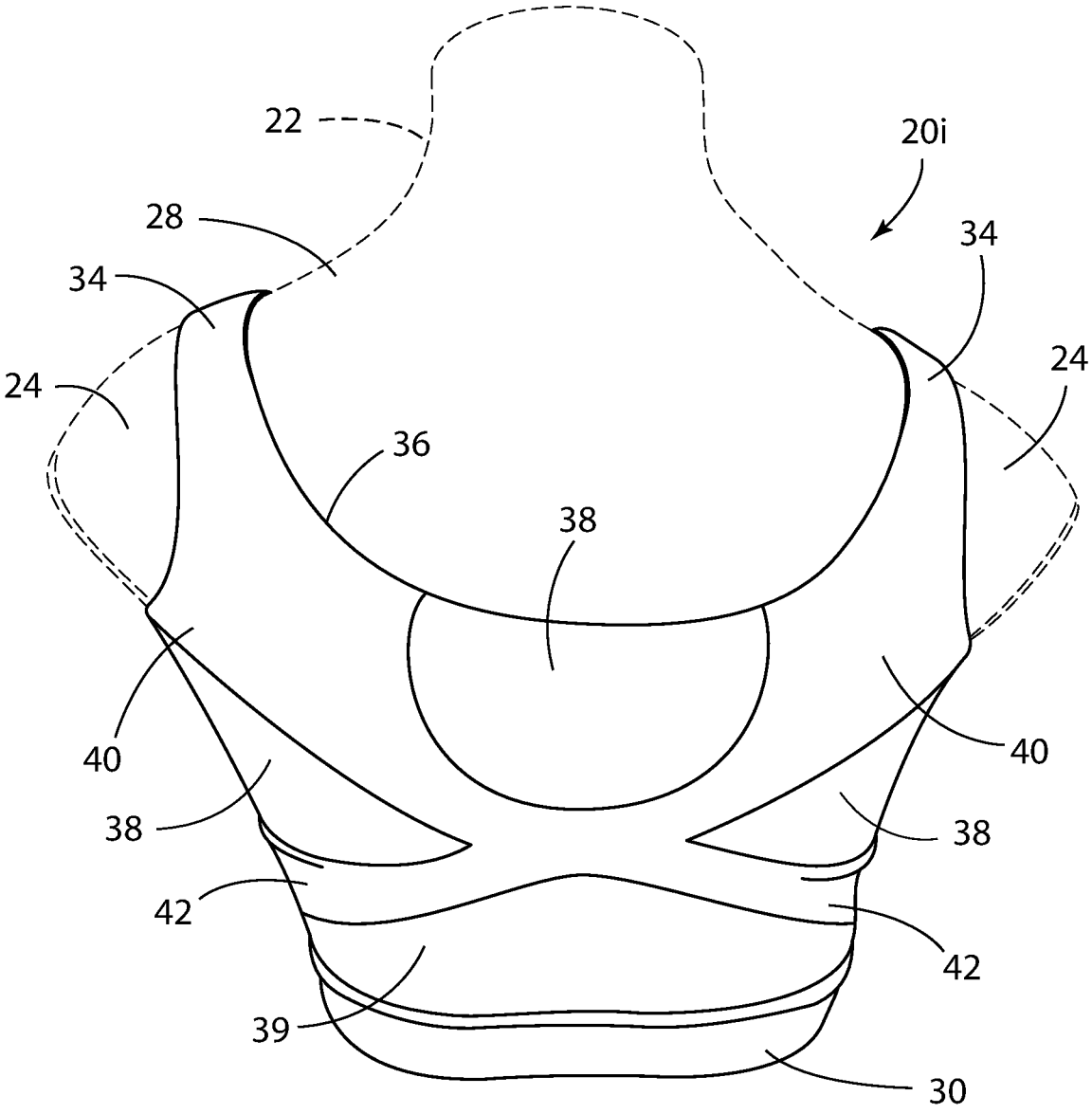
FIG. 14 illustrates a rear view of the support garment of FIG. 9.
Figure 15:
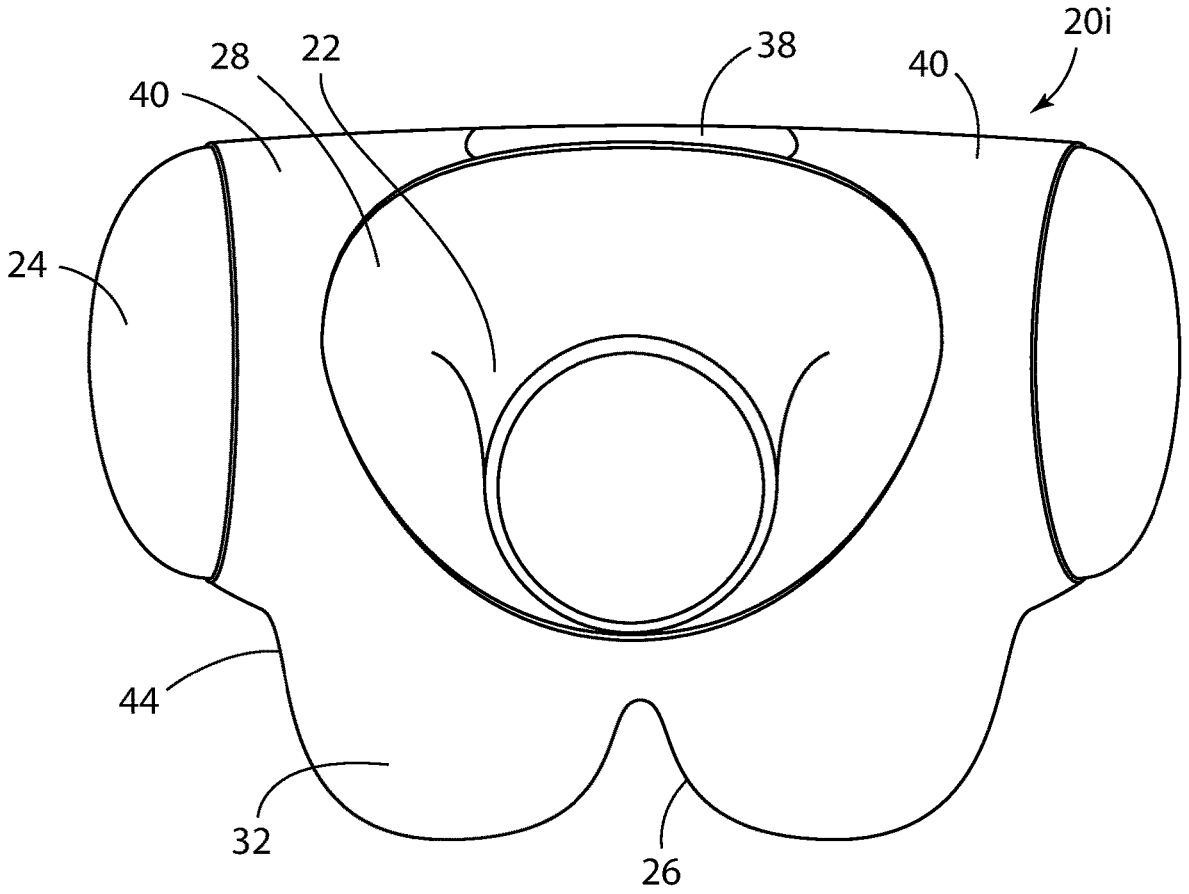
FIG. 15 illustrates a top view of the support garment of FIG. 9.
Figure 16:
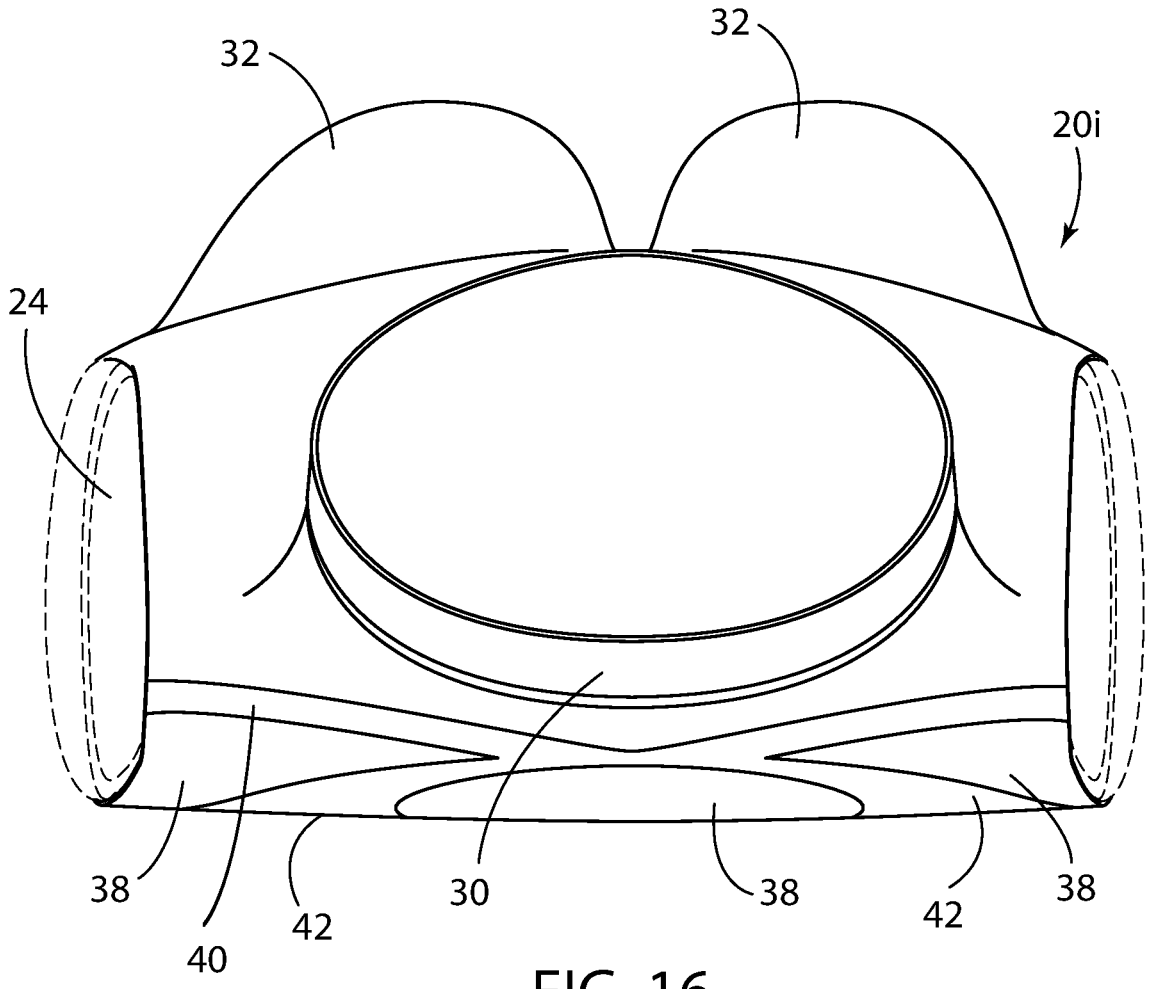
FIG. 16 illustrates a bottom view of the support garment of FIG. 9.

Shown in FIGS. 1-16 are two exemplary embodiments of the present support garments as described herein. Garment 20 (FIGS. 1-8) and alternate embodiment 20*i* (FIGS. 9-16) can be worn by a person 22 and may have arm openings 24, head opening 28, under bust band portion 30, cup portions 32, shoulder straps 34, seam edges 36, medial back portions 38 (See FIG. 6) which may be made of a looser or different construction to allow more air ventilation, upper back strap 40, lower back strap 42. Support garment may also have cup ruching (or pleating) 26 and side pleating or ruching 44 which is designed to support breasts. The band portion 30 may be up to twice the thickness of the portion of the garment adjacent to the band portion. It is noted that panels 38 represent one potential embodiment but that many other looser knit panels, designs and configurations are possible within the scope of the present invention. Portion 39 of garment 20, 20*i* is configured to provide an additional under breast support and may also be formed of a breathable fabric.

The fabric support garments 20, 20*i* may be made from a small, fine, flexible fabric, fiber, cloth or textile that can be smooth, pleated, ruched or textured, unscented or scented (such as therapeutic, lavender, chamomile, tea tree), one or more colors, solid or printed, accomplished through yarns, knitting, manufacturing processes, 3-D printing, weaving, and/or various garment printing techniques (such as color or pattern) and coating.

Middle breast region (e.g., cup 32) construction may provide extra coverage for comfort and concealment of the breast nipples, without requiring the use of bra pads or padding used in sports and other bras. This will be accomplished through knitting construction techniques, including use of yarn, fabric, and knitting stitches. Such construction may include an increased thickness in the cup region that is 50-200 percent thicker (preferably 100-200 percent thicker) than the other regions of support garment 20, 20*i*, surrounding the cup region 32. In one approach, the two cup regions are positioned above the band to receive the user's breasts, the cup regions being 100-200 percent thicker at a portion of the cup configured for placement of the user's nipple and tapering to a garment body thickness as the taper extends away from the nipple portion.

Arm openings 24, band 30 and neck opening 28 are configured to provide convenient ease of entry. For example, the neck opening 28 may be configured to be about 200 or 400 percent greater than or 2 to 4 times greater than the diameter of an average user 22's neck (e.g., using an average neck diameter of 4-6 inches). The arm openings 24 may be configured to be about 50 to 100 percent greater than the diameter of an average user 22's arms at the bicep (e.g., using an average bicep diameter of 3 to 5 inches). These configurations minimize friction against breast region and/or use of the arm and achieved by various materials such as yarn, fabric, knitting stitches and the like. These materials may provide for stretch and recovery/elasticity (e.g., the ability of an object or material to resume its normal shape after being stretched or compressed) of between 50-200 percent elasticity (i.e., the material may be stretched to 50-300 percent greater than its normal size). This elasticity allows a wearer to pull on the support garment overhead or to step into the garment. Elastic fibers may include such fibers as elastane fibers, polyether-polyurea copolymer material, and those sold under the tradenames LYRCA and SPANDEX. The elasticity may be achieved by elastic fibers comprising elastane or polyether-polyurea copolymer material in the range of 20-100 percent of total composition volume. In one embodiment, the composition of garment 20, 20*i* may comprise 10-30% polyamide and about 5-20% elastane.

Garment 20, 20*i* may be formed of material that is comfortable against the wearer's skin while providing support. Materials may include but is not limited to hypoallergenic yarns, fiber or other material made from elastane fibers, polyether-polyurea copolymer material, satin, silk, microtexture material, polyamide, acrylic, microfiber, linen, cotton, bamboo fiber fabric (bamboo viscose), hemp, flax, neoprene and combinations thereof. The materials may include a ribbed microtexture material. In one embodiment, the composition of garment 20, 20*i* material may comprise about 40-80 percent bamboo viscose.

The garment may have an optional front closure to further facilitate ease of use and placement. Such closures and fasteners may include zippers 46 (See FIG. 3), buttons, hook and loop fasteners, magnets, combinations thereof and the like. It is noted that the closures may be applied to the front, the back and the front and the back.

The construction of garment 20, 20*i* is configured to alleviate pain or pressure in sensitive areas, including but not limited to the breast region, under arm, and incisions in the breast region. This is achieved through garment design (including higher neckline and underarm), knitting technique around sensitive spots, including surgery incisions, breast nipples, lymph nodes, and neckline). The neck opening as shown is configured to extend up to the user's clavicular region 48 (i.e., near the clavicle bone).

The present garments 20, 20*i* may have a single body layer, although a second layer or pocket may be added. The second layer may be formed for soothing comfort such as an inner layer of silk or satin.

Middle area 50 of garment 20, 20*i* (See e.g., FIGS. 1 and 3) is configured to separate each breast region while maintaining contact directly or closely with the skin achieved through knitting construction, padding, cushions.

Band 30 is the bottom area of garment 20, 20*i* is configured to be seamless, provides support and lift, and eliminates skin-on-skin contact, particularly for large, heavy breast regions achieved through knitting construction, padding, cushions.

In some embodiments of garment 20, 20*i* may have a functional trim edge 36 around the top edge or the garment (the neck and arm holes), although other knitting or finishing techniques may be used.

Materials are selected for garment 20, 20*i* to optimize breathability or cool feeling material to keep the breast regions dry and cool. This may be accomplished through knitting construction, fabric or yarn selection. Care is taken for the cups not to compress the breast area.

The present embodiments are an advance in the art. For example, while many leisure or comfort bras on the market focus on softness, many contain narrow or thin straps or provide lower neckline (including deep V neck, scoop neck, providing exposure of portions of the breast region.

The present embodiments may contain additional breast nipple protection or coverage through knitting construction, additional bra layer or other mechanism attached to the bra. This is to minimize chafing, nipple prominence visible to others, and irritation. It is noted that the additional nipple protection referenced herein may be applied to not only the present embodiments, but is configured to be applied to any such support garments.

In some embodiments support garment 20, 20*i* may be formed of material that contains a healing effect such as, but not limited to, aloe, anti-bacterial or antimicrobial and may also include but is not limited to polyester, polyester-vinyl composites, vinyl, acrylics, linen (which may add an additional antimicrobial effect), merino wool, and hemp or anti-moisture including moisture wicking or breathable fabrics including but not limited to polyester, polypropylene, merino wool, wool, nylon, micromodal and bamboo. This may also be achieved through yarn selection or coating or finishing processes.

Shoulder straps are integral with the body layer of the support garment of the same material. This leverages modern knitting technology capability and differs from many leisure bras that have thin bra straps attached typically through cut and sew methods.

Support garment 20, 20*i* construction may be configured to leverage knitting technologies that minimize cut and sew techniques. This reduces/eliminates offcuts thrown away during production of such garments. Seamless construction using 3-D printing, sewing, circular knitting, flat knitting, and bonding techniques, with no side seams or bottom seams, although minimal cut and sewing may be used.

Other materials and considerations for the present embodiments are presented. Such considerations may include forming the garment of material(s) that contain cooling, anti-itching or anti-burning ointments, properties, or effect. In some embodiments, the garment materials may include properties that repels ointments, gels, lotions or other topical treatment products. In some embodiments, the garment materials may include anti-radiation or other protective attributes, to reduce exposure to radio frequency (RF) radiation, electric and magnetic fields (EMFs), ultraviolet radiation. This can be achieved through various methods, including but not limited to conductive textiles, yarns, coating and finishing techniques or garment construction. In short, of the above may be achieved through yarn containing or coated or impregnated with these specified properties, coating or finishing techniques or other aids incorporated into the fabric.

For example, breathable fabrics may include various combinations of cotton, polyester, nylon, rayon, linen, silk, micromodal, merino wool, chambray, and those sold under the name GORETEX. Moisture wicking materials may include various combinations of polyester, polypropylene, merino wool, wool, nylon, micromodal or bamboo. Cooling, anti-itch and anti-burn materials may be hydrocortisone anti-itch cooling gels. Topical ointments, creams and antiseptics may also be coated on the garment materials. EMF and radiation protective materials may include EMF shielding silver fabric, yarn or materials; conductive CuNi cloth, material or yarn.

According to one approach, a support garment of any type, including the present embodiments may be impregnated or coated in materials selected for properties selected from the group: cooling, anti-burning and anti-itch, anti-radiation, anti-radio frequency (RF) radiation blocking, electric and magnetic fields (EMFs) blocking, ultraviolet radiation blocking, and combinations thereof. In a non-limiting example, in one approach the garment material may include an EMF blocking and radiation blocking material, yarn or composite. By way of a non-limiting example, in one approach the EMF blocking and radiation blocking material, yarn or composite may have 2-15 percent by total composition weight silver fiber and 2-15 percent total composition weight hydrocortisone anti-itch cooling gel coatings.

While the embodiments have been described in conjunction with specific embodiments, it is evident that many alternatives, modifications and variations will be apparent to those skilled in the art in light of the foregoing description. Accordingly, the present embodiments attempt to embrace all such alternatives, modifications and variations that fall within the spirit and scope of the appended claims. Throughout this specification and the drawings and figures associated with this specification, numerical labels of previously shown or discussed features may be reused in another drawing figure to indicate similar features.

LIST OF REFERENCE NUMBERS

20 support garment
22 person
24 arm opening
26 cup pleating/ruching
28 head opening
30 under bust band portion
32 cup portions
34 shoulder straps
36 seam edges
38 back portion ventilation panels
39 torso support band
40 upper back strap
42 lower back strap
44 side pleating/ruching
46 front closure
48 clavicular region
50 middle area between cups

I claim:

1. A seamless support garment configured for use by a person, the garment comprising:

first and second arm openings configured to be about 50 or 100 percent greater than an arm diameter of the person at a bicep of 3-5 inches;

a neck opening configured to be about 2 to 4 times greater than a neck diameter of the person of 4-6 inches;

a portion of the arm openings and neck opening opposite each other form integral shoulder straps;

a torso opening portion configured to fit at an under bust of the person consisting of a seamless elastic band, the band being twice the thickness of a portion of the garment adjacent to the band;

two cup regions positioned above the band to receive breasts of the person, the two cup regions being 100-200 percent thicker at a portion of the two cup regions configured for placement of nipples of the person than at other regions of the support garment and tapering to a garment body thickness wherein the taper is configured to extend away from the person's nipples;

wherein, the support garment comprises a material having between 50-200 percent elasticity;

wherein a portion of the garment defining a middle area between the two cup regions is configured to separate, lift and support each breast of the person by the two cup regions while maintaining direct contact with the person, which is achieved by ruching;

wherein a portion of the garment defining a left and right side comprises side ruching to support each breast of the person; and wherein a middle portion between the two cup regions configured to separate each breast of the person while maintaining contact directly or closely with the skin is achieved through one of knitting construction, padding and cushions wherein the middle area further comprises a front closure positioned between the cups of the garment selected from the group consisting of zippers, buttons, hook and loop fasteners, magnets and combinations thereof.

2. The support garment of claim 1, wherein the elasticity is achieved by elastic fibers comprising elastane or polyether-polyurea copolymer material in the range of 20-100 percent of total composition volume.

3. The support garment of claim 1, wherein the neck opening is configured to extend up to a clavicular region of the person.

4. The support garment of claim 1, further comprising a second layer composed of silk or satin.

5. A seamless support garment configured for use by a person, the garment comprising:

first and second arm openings configured to be about 50 or 100 percent greater than an arm diameter of the person at a bicep of 3-5 inches;

a neck opening configured to be about 2 to 4 times greater than a neck diameter of the person of 4-6 inches;

a portion of the arm openings and neck opening opposite each other form integral shoulder straps;

a torso opening portion configured to fit at an under bust of the person consisting of a seamless elastic band, the band being twice the thickness of a portion of the garment adjacent to the band;

two cup regions positioned above the band to receive breasts of the person, the two cup regions being 100-200 percent thicker at a portion of the two cup regions configured for placement of nipples of the person than at other regions of the support garment and tapering to a garment body thickness wherein the taper is configured to extend away from the person's nipples;

wherein a garment material is selected from the group consisting of elastic fibers, hypoallergenic yarns, fiber, acrylic, microfiber, linen, hemp, bamboo, flax, neoprene, and combinations thereof;

wherein a portion of the garment defining a middle area between the two cup regions is configured to separate, lift and support each breast of the person by the two cup regions while maintaining direct contact with the person, which is achieved by ruching;

wherein a portion of the garment defining a left and right side comprises side ruching to support each breast of the person; and wherein a middle portion between the two cup regions configured to separate each breast of the person while maintaining contact directly or closely with the skin is achieved through one of knitting construction, padding and cushions wherein the middle area further comprises a front closure positioned between the cups of the garment selected from the group consisting of zippers, buttons, hook and loop fasteners, magnets and combinations thereof.

6. The support garment of claim 5, wherein the garment comprises 40-80 percent bamboo viscose.

7. The support garment of claim 5, wherein the garment is impregnated or coated in compositions selected for properties selected from the group consisting of: cooling, anti-burning, anti-itch, radiation blocking, anti-radio frequency (RF) radiation blocking, electric and magnetic fields (EMFs) blocking, ultraviolet radiation blocking, and combinations thereof.

8. The support garment of claim 7, wherein the EMF blocking and radiation blocking compositions comprise 2-15 percent by total composition weight silver fiber and 2-15 percent total composition weight hydrocortisone anti-itch cooling gel coatings.

9. The support garment of claim 5, wherein the garment comprises an EMF blocking and radiation blocking yarn or composites having 2-15 percent by total composition weight silver fiber and 2-15 percent total composition weight hydrocortisone anti-itch cooling gel coatings.

10. A seamless support garment configured for use by a person, the garment comprising:

first and second arm openings configured to be about 50 or 100 percent greater than an arm diameter of the person at a bicep of 3-5 inches;

a neck opening configured to be about 2 to 4 times greater than a neck diameter of the person of 4-6 inches;

a portion of the arm openings and neck opening opposite each other form integral shoulder straps;

a torso opening portion configured to fit at an under bust of the person consisting of a seamless elastic band, the band being twice the thickness of a portion of the garment adjacent to the band;

two cup regions positioned above the band to receive breasts of the person, the two cup regions being 100-200 percent thicker at a portion of the two cup regions configured for placement of nipples of the person than at other regions of the support garment and tapering to a garment body thickness wherein the taper is configured to extend away from the person's nipples;

wherein the garment comprises a material is selected from the group consisting of anti-bacterial or antimicrobial materials, polyester, polyester-vinyl composites, vinyl, acrylics, linen, merino wool, hemp, anti-moisture materials, moisture wicking materials, breathable fabrics, polypropylene, merino wool, wool, nylon, micromodal, bamboo, and combinations thereof;

wherein a portion of the garment defining a middle area between the two cup regions is configured to separate, lift and support each breast of the person by the two cup regions while maintaining direct contact with the person, which is achieved by ruching;

wherein a portion of the garment defining a left and right side comprises side ruching to support each breast of the person and wherein a middle portion between the two cup regions configured to separate each breast of the person while maintaining contact directly or closely with the skin is achieved through one of knitting construction, padding and cushions wherein the middle area further comprises a front closure positioned between the cups of the garment selected from the group consisting of zippers, buttons, hook and loop fasteners, magnets and combinations thereof.

* * * * *